US007694620B1

(12) United States Patent
Narus

(10) Patent No.: US 7,694,620 B1
(45) Date of Patent: Apr. 13, 2010

(54) MACHINE GUN MAGAZINE SUPPORT

(75) Inventor: Michael J. Narus, Florham Park, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 11/672,626

(22) Filed: Feb. 8, 2007

Related U.S. Application Data

(60) Provisional application No. 60/766,827, filed on Feb. 14, 2006.

(51) Int. Cl.
*F41A 9/61* (2006.01)

(52) U.S. Cl. ..... 89/33.1; 89/195; 89/197; 89/33.02; 42/49.01; 42/49.02; 42/50

(58) Field of Classification Search ..... 42/49.02, 42/49.01, 50; 89/195, 197, 33.02, 33.1
See application file for complete search history.

(56) References Cited

U.S. PATENT DOCUMENTS 2,032,376 A * 3/1936 Moore ..... 89/33.2
4,112,817 A * 9/1978 Bourlet ..... 89/33.1
4,392,407 A * 7/1983 LaFever et al. ..... 89/33.14
4,939,979 A * 7/1990 Capawana ..... 89/34
6,152,012 A * 11/2000 Sherwood ..... 89/33.4
7,073,285 B2 * 7/2006 Obong ..... 42/90
7,428,795 B2 * 9/2008 Herring ..... 42/75.01
2006/0283067 A1 * 12/2006 Herring ..... 42/75.01
2007/0022650 A1 * 2/2007 Obong ..... 42/90

* cited by examiner

*Primary Examiner*—Bret Hayes
*Assistant Examiner*—Michael D David
(74) *Attorney, Agent, or Firm*—John F. Moran

(57) ABSTRACT

A magazine support reinforcement for a machine gun having a receiver. A magazine support is attached to the underside of the receiver. The magazine support reinforcement is connected to the magazine support. The reinforcement includes a front support, a rear support and a fastener for fastening the front support to the rear support. The front and rear supports include bracing members having a generally concave side and a lug portion.

6 Claims, 6 Drawing Sheets

MACHINE GUN MAGAZINE SUPPORT

CROSS-REFERENCE TO RELATED APPLICATIONS

This application claims the benefit under 35 USC 119(e) of U.S. provisional patent application No. 60/766,827 filed on Feb. 14, 2006, which application is hereby incorporated by reference.

STATEMENT OF GOVERNMENT INTEREST

The inventions described herein may be manufactured, used and licensed by or for the U.S. Government for U.S. Government purposes.

BACKGROUND OF THE INVENTION

The invention relates to munitions and in particular to ammunition feeding mechanisms for machine guns.

Machine guns primarily use large magazines that hold belted ammunition. The large magazines may hold 100 or 200 rounds. These large magazines are attached to the magazine support of the machine gun. Under rough handling conditions, the magazine support fails to securely hold the large ammunition magazines. This problem has existed with the M249 machine gun since it was fielded in the 1980s.

Select machine guns, such as the M249, may also use a small magazine (30 rounds of unbelted ammunition) as a secondary ammunition supply. When using the small magazine, the magazine is inserted into a magazine well attached to the gun. The magazine well includes a rectangular opening for receiving the small magazine. The magazine well is attached to the side of the receiver and to the magazine support. The magazine support is attached at one end to an underside of the gun receiver and at the other end to the magazine well. Of course, the large magazines (100 or 200 rounds) cannot use the magazine well.

Various changes have been made to the large ammunition magazines to solve the lack of support problem. Different plastics have been used to construct the magazines. Metal stiffeners have been inserted in the magazines to keep them from bending. Bending of the large magazine beyond a certain point causes the large magazine to pop out of the magazine support. These fixes have only slightly increased the magazine retention capabilities. Notably, these fixes cause the magazine support to bend and the large magazines to pop out. Thus, there is a need for a device that prevents the magazines from bending and popping out of the magazine support.

SUMMARY OF THE INVENTION

It is an object of the invention to provide an apparatus to strengthen the magazine support of a machine gun.

It is another object of the invention to provide an apparatus that strengthens the magazine support while still allowing both small and large magazines to be used.

It is a further object of the invention to provide such an apparatus that may be installed on an existing machine gun without removing any parts or permanently modifying the gun.

One aspect of the invention is a machine gun comprising a receiver having an underside;

a magazine support attached to the underside; and a magazine support reinforcement connected to the magazine support, the reinforcement comprising a front support, a rear support and a fastener for fastening the front support to the rear support.

The magazine support comprises a pair of flanges on its edges. The front and rear supports each include a bracing member having a generally concave side for mating with external surfaces of the pair of flanges on the magazine support. The front and rear supports each include a lug portion with an opening therein for receiving the fastener.

Another aspect of the invention is an apparatus for reinforcing a magazine support on a machine gun, the apparatus comprising a front support including a bracing member and a lug portion; a rear support including a bracing member and a lug portion; and a fastener for fastening the front support to the rear support.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

Figure 1A:
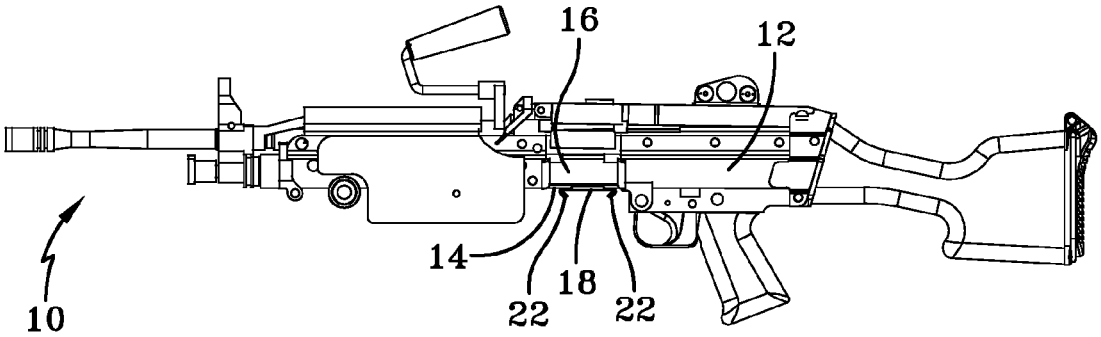
FIG-1A PRIOR ART
FIGS. 1A, 1B and 1C are left side, bottom and right side views of a known machine gun.
Figure 1B:
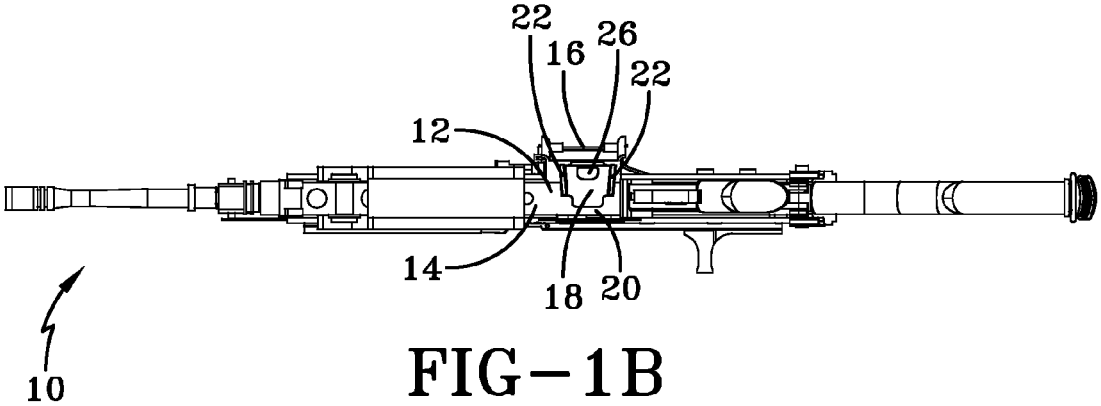
FIG-1B PRIOR ART
Figure 1C:
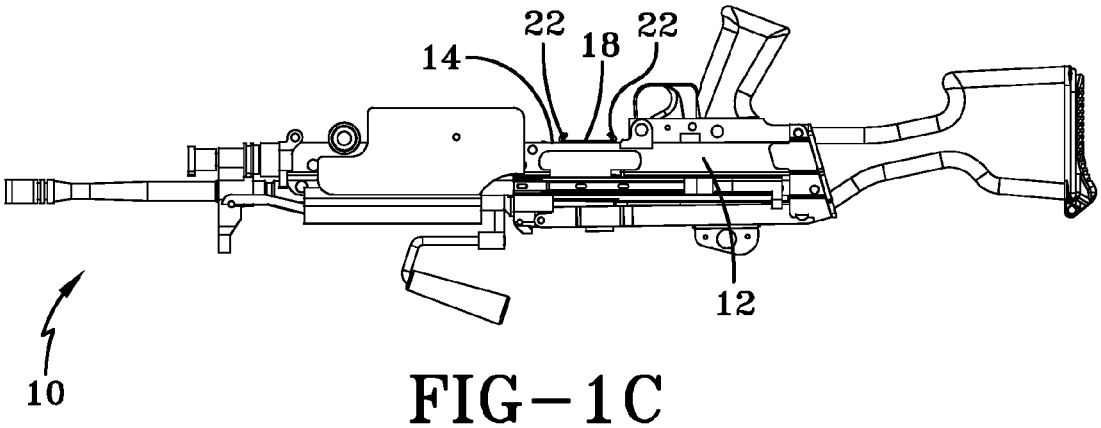
FIG-1C PRIOR ART

FIGS. 1A, 1B and 1C are left side, bottom and right side views of a known machine gun 10. Gun 10 includes a receiver portion 12 having an underside 14. Magazine support 18 is attached at one end 20 to receiver underside 14 and at another end 28 (FIG. 2B) to magazine well 16. Magazine well 16 receives smaller magazines, such as 30 round magazines.

Figure 2A:
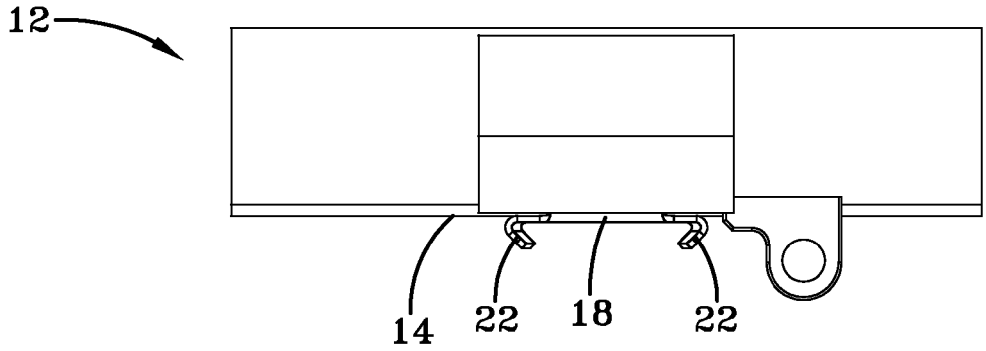
FIG-2A PRIOR ART
FIGS. 2A, 2B and 2C are left side, bottom and right side enlarged views of a portion of the gun of FIGS. 1A-1C.
Figure 2B:
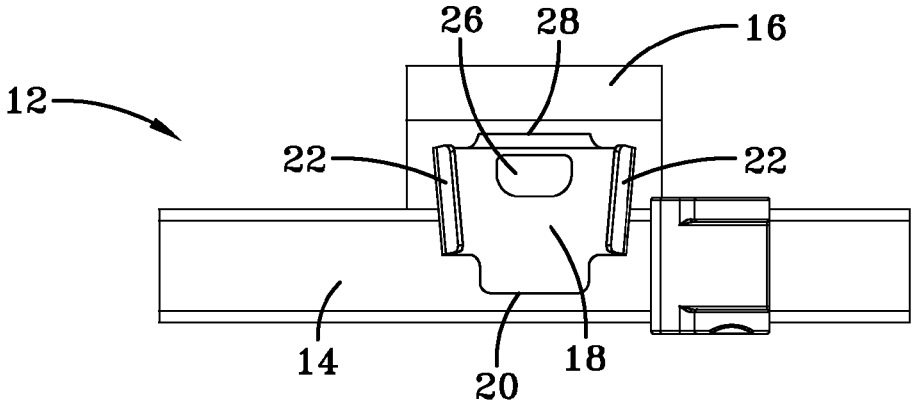
FIG-2B PRIOR ART
Figure 2C:
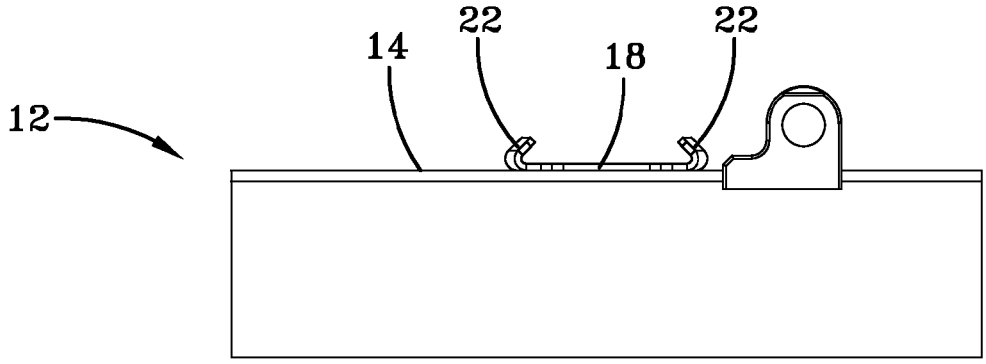
FIG-2C PRIOR ART

FIGS. 2A, 2B and 2C are left side, bottom and right side enlarged views of a portion of the gun 10 of FIGS. 1A-1C. Magazine support 18 includes a pair of flanges 22 on its edges. The flanges 22 curve inward toward each other (FIG. 1A and 2A) and also angle inward toward each other (FIG. 1B and 2B) from the left to the right side of gun 10 to form one portion of a dovetail type joint. An opening 26 formed in the magazine support 18 is generally D-shaped and is used as a "catch" for a protrusion on the larger magazines.

Figure 3:
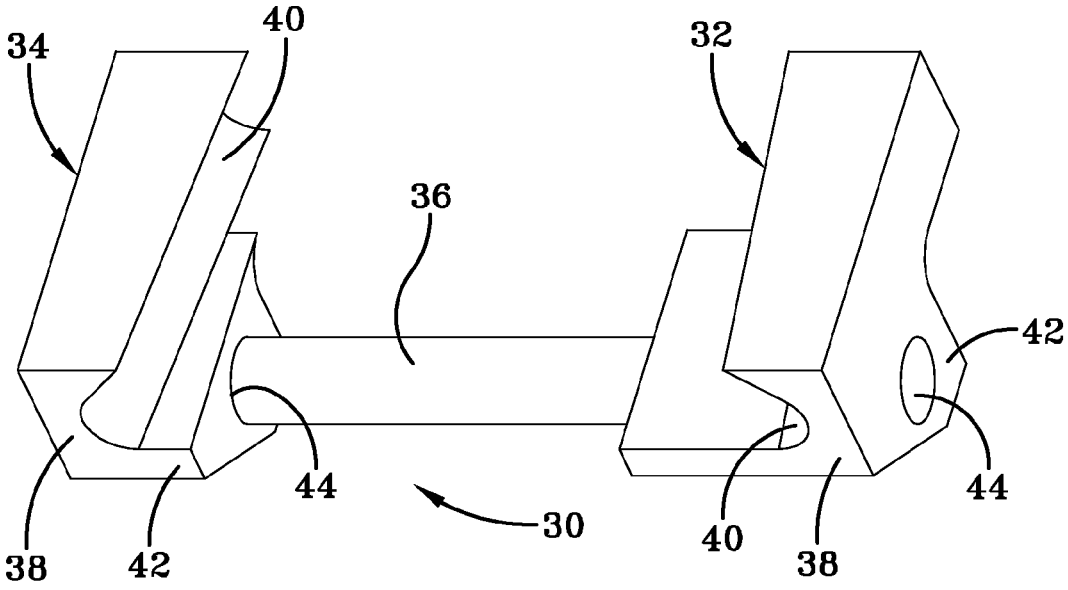
FIG. 3 is a perspective view one embodiment of a reinforcing apparatus for the magazine support.
Figure 4:
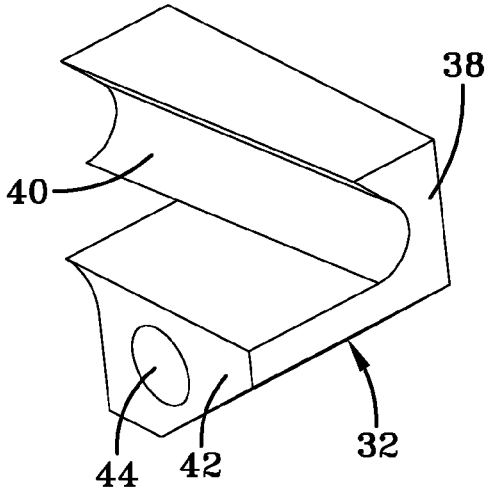
FIGS. 4 and 5 are perspective views of the front and rear supports, respectively.
Figure 5:
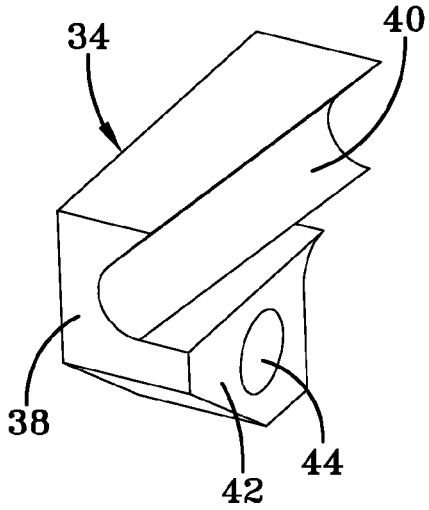

FIG. 3 is a perspective view a reinforcing apparatus 30 for the magazine support 18. Apparatus 30 comprises a front support 32, a rear support 34 and a fastener 36. FIGS. 4 and 5 are perspective views of the front and rear supports 32, 34, respectively. The front support 32 is located towards the muzzle end of the gun 10 and the rear support 34 is located towards the butt end of the gun 10.

The front and rear supports 32, 34 each include a bracing member 38 having a generally concave side 40 for mating with the external surfaces of the pair of flanges on the magazine support 18. The front and rear supports 32, 34 each also include a lug portion 42 with an opening 44 therein for receiving the fastener 36. One of the openings 44 is threaded and the other opening 44 includes a countersunk portion for receiving the head of the fastener 36, such as a cap screw. It is to be understood that the head of cap screw 36 and its threaded screw portion are respectively concealed in front support 42 and rear support 42. For this reason, they are not shown in FIG. 3. Only the end portion of cap screw 36 hidden in opening 44 is threaded in order to reduce machining costs since only that end requires threads for adjusting the apparatus of FIG. 3 when positioned on flanges 22 shown most clearly as bracing members 38 of the front and rear supports 32 and 34 in the subsequent description of FIG. 8.

Figure 6A:
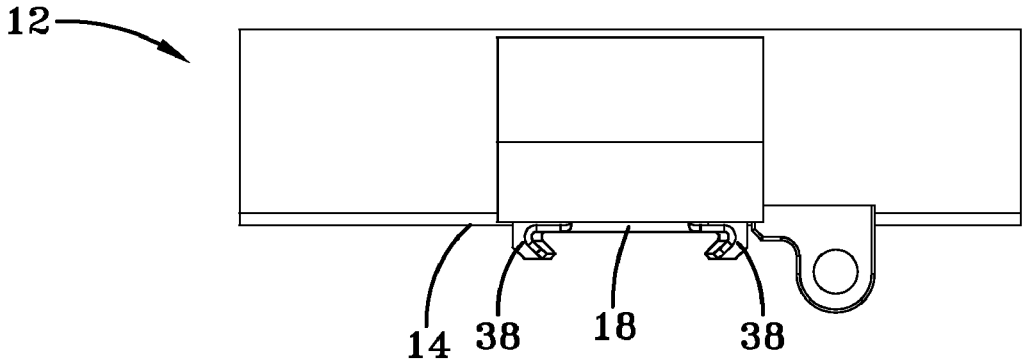
FIGS. 6A, 6B and 6C are left side, bottom and right side enlarged views of a portion of the gun of FIGS. 1A-1C including a reinforcing apparatus.
Figure 6B:
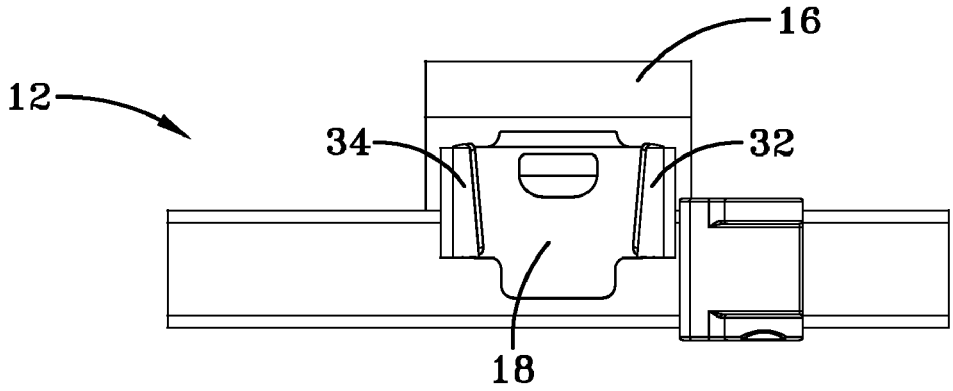
Figure 6C:
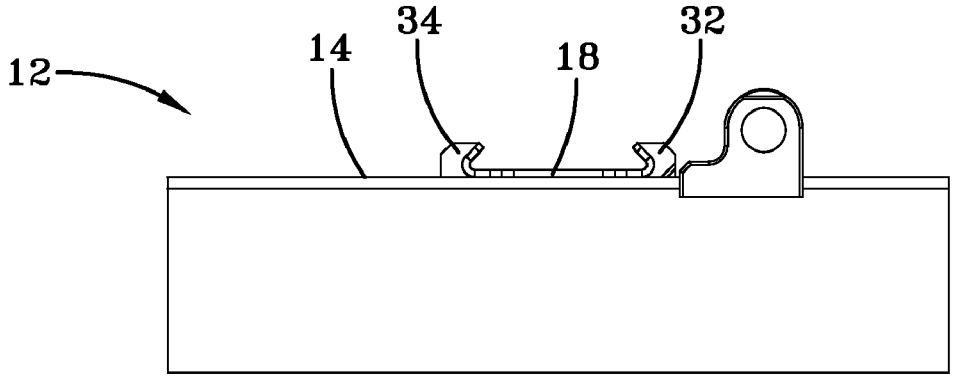

FIGS. 6A, 6B and 6C are left side, bottom and right side enlarged views of a portion of the gun 10 of FIGS. 1A-1C including the reinforcing apparatus 30. The bracing members 38 of the front and rear supports 32, 34 fit over flanges 22 so that the concave sides 40 mate with the external surfaces of the flanges 22. The fastener 36 (FIG. 3) is inserted through the openings 44 in the lug portions 42 and is tightened until the supports 32, 34 are snug around the magazine support 18.

Figure 7A:
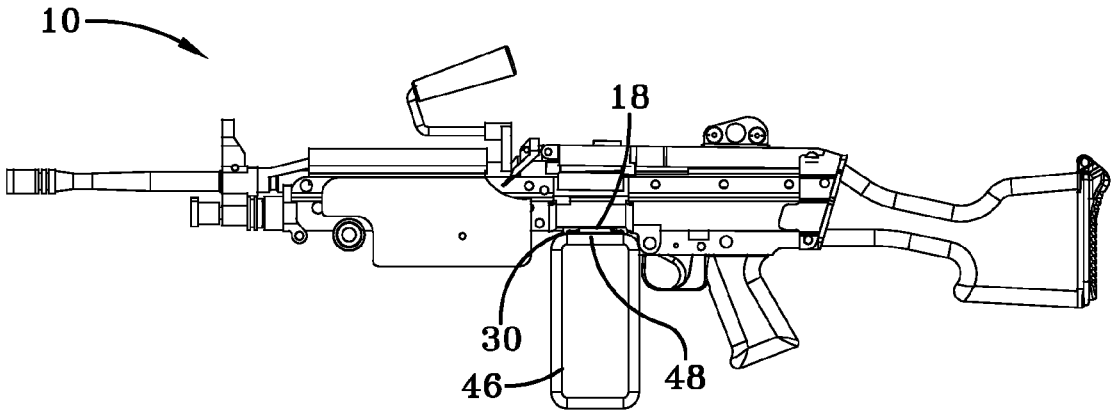
FIGS. 7A, 7B and 7C are left side, bottom and right side views of the gun of FIGS. 1A-1C including a reinforcing apparatus and a magazine.
Figure 7B:
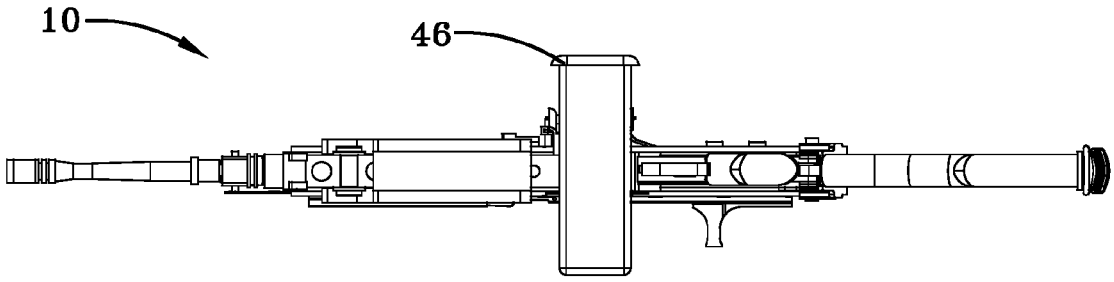
Figure 7C:
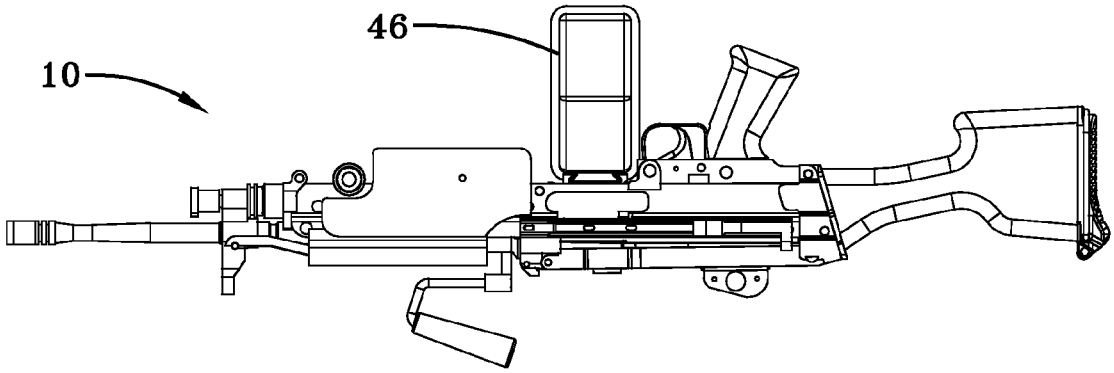
Figure 8:
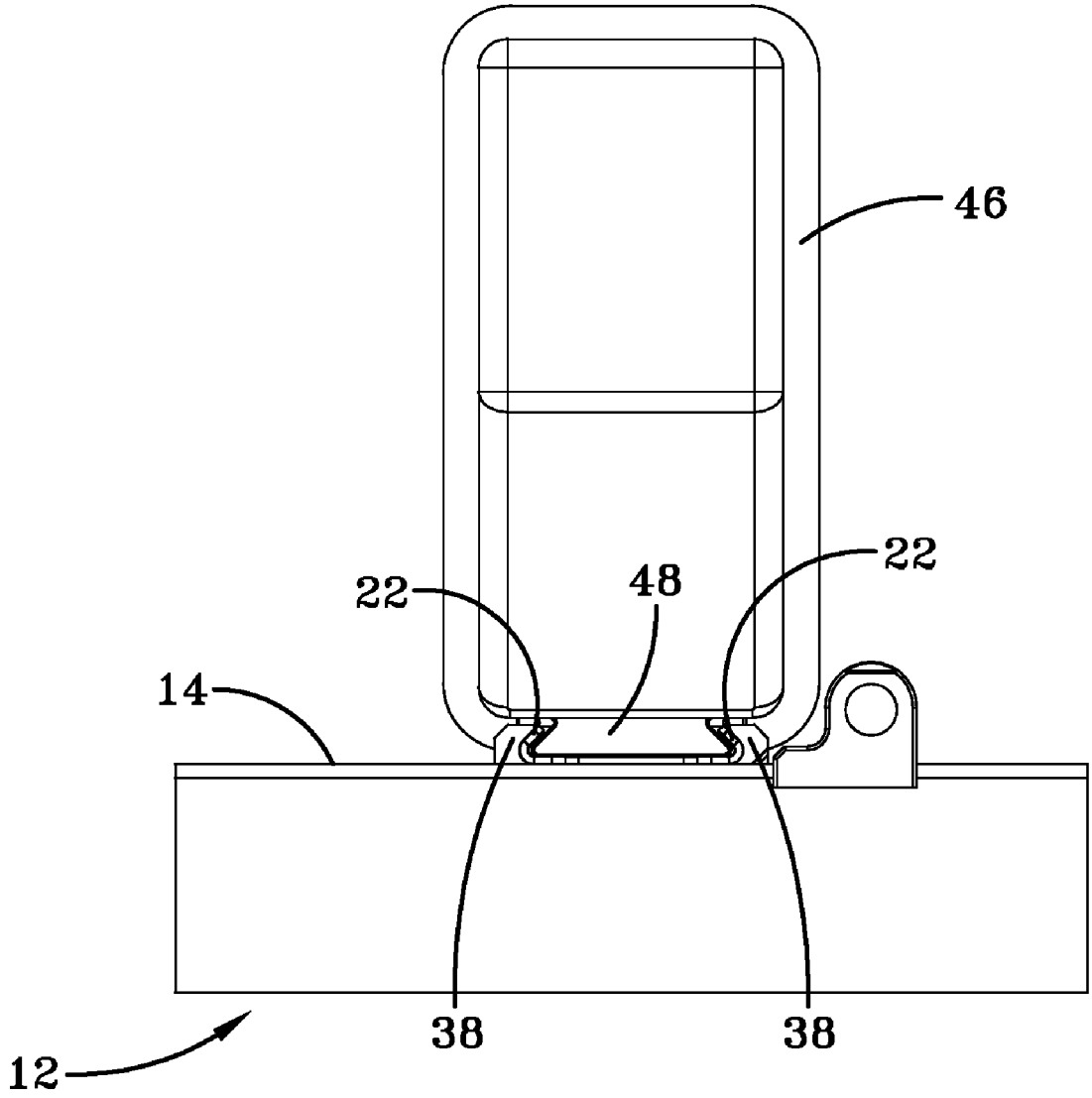
FIG. 8 is an enlarged view of a portion of FIG. 7A.

FIGS. 7A, 7B and 7C are left side, bottom and right side views of the gun 10 of FIGS. 1A-1C including a reinforcing apparatus 30 and a large (100 or 200 round) magazine 46. FIG. 8 is an enlarged view of a portion of FIG. 7C. As best seen in FIG. 8, magazine 46 includes one portion 48 of a dovetail joint that mates with the flanges 22 of magazine support 18. The magazine 46 is inserted into magazine support 18 from left to right. A latch (not shown) on the top of magazine 46 fits into the opening 26 (FIG. 2B) to latch the magazine 46 in the magazine support 18. The bracing members 38 of the front and rear supports 32, 34 prevent the flanges 22 of the magazine support 18 from bending outwards. Thereby, the reinforcing apparatus 30 prevents the magazine support 18 from deforming and the magazine 46 from popping out of the magazine support 18.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A machine gun, comprising:

a receiver having an underside;

a magazine support attached to the underside; the magazine support having two flange members for receiving a magazine placed between them, and an apparatus comprising; a front support member, a rear support member and a fastener, the fastener having a first end and a second end, the fastener connecting the front support to the rear support wherein the rear support is disposed at the first end of the fastener and the front support is disposed at the second end of the fastener, the front support contacting one flange of the magazine support and the rear support contacting the other flange of the magazine support wherein adjustment of the fastener provides a snug supporting force on the flange members securing each magazine received by the flange members to the gun.

2. The gun of claim 1 wherein the front support member and the rear support member each include a bracing member having a generally concave inner side for contacting with an external of each of the two flanges of the magazine support.

3. The gun of claim 1 wherein the front support member and rear support member each include a lug portion having an opening for receiving the fastener.

4. The gun of claim 3 wherein the two flanges curve inward toward each other.

5. The gun of claim 4 wherein the two flanges angle inward toward each other from one side of the gun to the other side of the gun.

6. The gun of claim 5 wherein the bracing members angle inward toward each other in the same orientation as the two flanges.

* * * * *